US005512869A

United States Patent [19]

Thuries

[11] Patent Number: 5,512,869

[45] Date of Patent: Apr. 30, 1996

[54] LINEAR CONTROL APPARATUS FOR A CIRCUIT-BREAKER

[75] Inventor: Edmond Thuries, Meyzieu, France

[73] Assignee: GEC Alsthom T & D SA, Paris, France

[21] Appl. No.: 362,928

[22] Filed: Dec. 23, 1994

[30] Foreign Application Priority Data

Dec. 27, 1993 [FR] France ..... 93 15694

[51] Int. Cl.[6] ..... H01H 9/00

[52] U.S. Cl. ..... 335/177; 335/185; 335/190

[58] Field of Search ..... 335/126, 136, 335/185–190, 177–179

[56] References Cited

U.S. PATENT DOCUMENTS

| | | | |
|---|---|---|---|
| 1,606,738 | 11/1926 | Austin | 335/177 |
| 3,304,444 | 2/1967 | Smith | 335/177 |
| 3,772,620 | 11/1973 | Harris | 335/190 |
| 3,845,433 | 10/1974 | Kraulits . | |

FOREIGN PATENT DOCUMENTS

0221430A1 5/1987 European Pat. Off. .

*Primary Examiner*—Lincoln Donovan

*Attorney, Agent, or Firm*—Sughrue, Mion, Zinn, Macpeak & Seas

[57] ABSTRACT

Linear control apparatus for a circuit-breaker, the apparatus including a slidably-mounted tubular arm actuated by a solenoid, and a "disengagement" first slide which presses against the tubular arm, the first slide being subjected to a first spring assembly. The control end of the drive rod is coupled to the tubular arm via at least one projecting portion passing through a respective longitudinal slot provided along the tubular arm. The control apparatus includes an "engagement" second slide to which the drive rod is fixed via its projecting portion, the engagement second slide being subjected to an "engagement" second spring assembly which displaces it from the circuit-breaker disengaged position to the circuit-breaker engaged position under the action of second control means.

7 Claims, 4 Drawing Sheets

LINEAR CONTROL APPARATUS FOR A CIRCUIT-BREAKER

FIELD OF THE INVENTION

The present invention relates to control apparatus for a circuit-breaker.

More precisely, the present invention concerns linear control apparatus for engaging and disengaging a circuit-breaker that includes a drive rod provided with a control end, the apparatus itself including a slidably-mounted tubular arm which is actuated by a solenoid, which has the same longitudinal axis as the drive rod, and which is coupled to the drive rod whose control end is inside the tubular arm, and a "disengagement" first slide which presses against the tubular arm and through which the drive rod passes, the first slide being subjected to a "disengagement" first spring assembly which displaces it from the circuit-breaker engaged position to the circuit-breaker disengaged position under the action of first control means actuated on disengagement.

BACKGROUND OF THE INVENTION

In such known circuit-breaker control apparatus, disengagement is performed by means of the disengagement spring assembly which is constituted by a helical spring that is coaxial with the drive rod, with one of its ends pressed against a fixed portion, and with its other end pressed against the first slide, the spring being held compressed in the circuit-breaker disengaged position by the control means constituted by retractable slide-retaining means for retaining the slide. On disengagement, said slide-retaining means are retracted, and the released spring drives the slide and therefore the tubular arm, thereby driving the drive rod and opening the contacts of the circuit-breaker. On engagement, the drive is provided by the solenoid on its own, with the tubular arm driving the slide against the force of the spring which is re-compressed until it is latched by the retaining means, and also driving the drive rod to the engaged position in which the contacts are closed.

That type of control suffers from the drawback that it is dangerous on engagement, because the drive for performing such engagement is provided by the solenoid on its own, and if a malfunction occurs in the solenoid, the contacts might not be closed, or, in particular, they might be closed abnormally.

The present invention solves this problem by providing apparatus such that the control end of the drive rod is coupled to the tubular arm via at least one projecting portion fixed to the drive rod and passing through a respective longitudinal slot provided along the tubular arm, and such that the control apparatus includes an "engagement" second slide to which the drive rod is fixed via its projecting portion, the engagement second slide being subjected to an "engagement" second spring assembly which displaces it from the circuit-breaker disengaged position to the circuit-breaker engaged position under the action of second control means actuated on engagement.

In a first variant embodiment of the first spring assembly, said first spring assembly is constituted by a helical spring which is coaxial with the drive rod, and which has one of its ends pressed against a first fixed portion and its other end pressed against the first slide, the first spring being held compressed in the circuit-breaker engaged position by the first control means constituted by retractable slide-retaining means for retaining the first slide.

In a second variant embodiment of the first spring assembly, said first spring assembly is constituted by two telescopic arms which have their longitudinal axes lying in the same plane, each one of the facing ends of the arms being connected to the first slide via a respective pivoting link, and the other end of each arm being pivotally fixed to a respective fixed point, a spring surrounding the arm being compressed between the pivoting link and the fixed end, and the first control means are preferably constituted by a drive member for driving the first slide.

In a first variant of the second spring assembly, said second spring assembly is constituted by a helical spring which is coaxial with the tubular arm, and which has one of its ends pressed against a second fixed portion and its other end pressed against the second slide to which the drive rod is fixed via its projecting portion, the second spring being held compressed in the circuit-breaker disengaged position by the second control means constituted by retractable slide-retaining means for retaining the second slide.

In a second embodiment of the second spring assembly, said second spring assembly is constituted by two telescopic arms which have their longitudinal axes lying in the same plane, each one of the facing ends of the arms being connected to the second slide via a respective pivoting link, and the other end of each arm being pivotally fixed to a respective fixed point, a spring surrounding the arm being compressed between the pivoting link and the fixed end, and the second control means are preferably constituted by a drive member for driving the second slide.

BRIEF DESCRIPTION OF THE DRAWINGS

The invention is described below in more detail with reference to the accompanying drawings which show a preferred embodiment of the invention, and in which.

MORE DETAILED DESCRIPTION

Figure 1A:
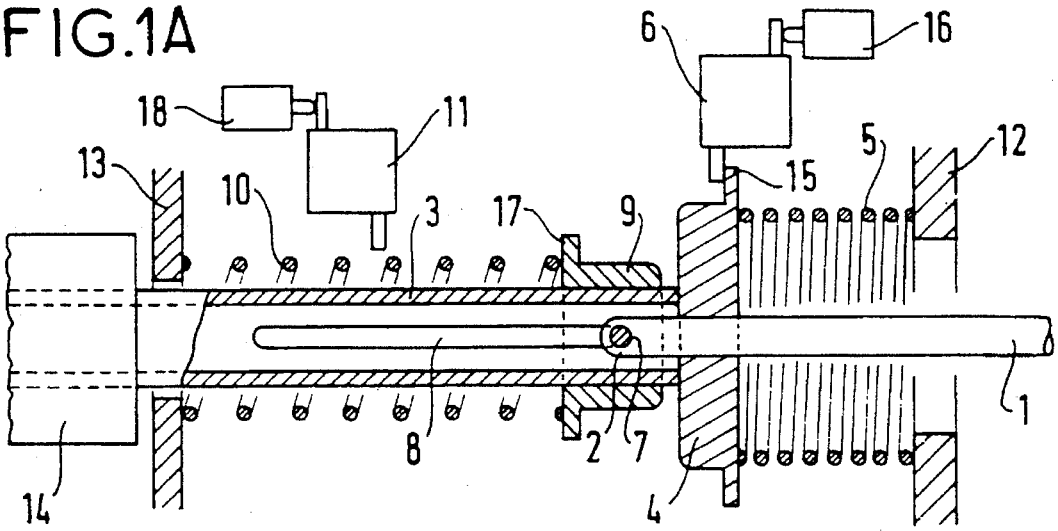
FIGS. 1A, 1B, and 1C are longitudinal section views through a first variant embodiment of the apparatus of invention, respectively in the engaged position, during disengagement, and in the disengaged position.
Figure 1B:
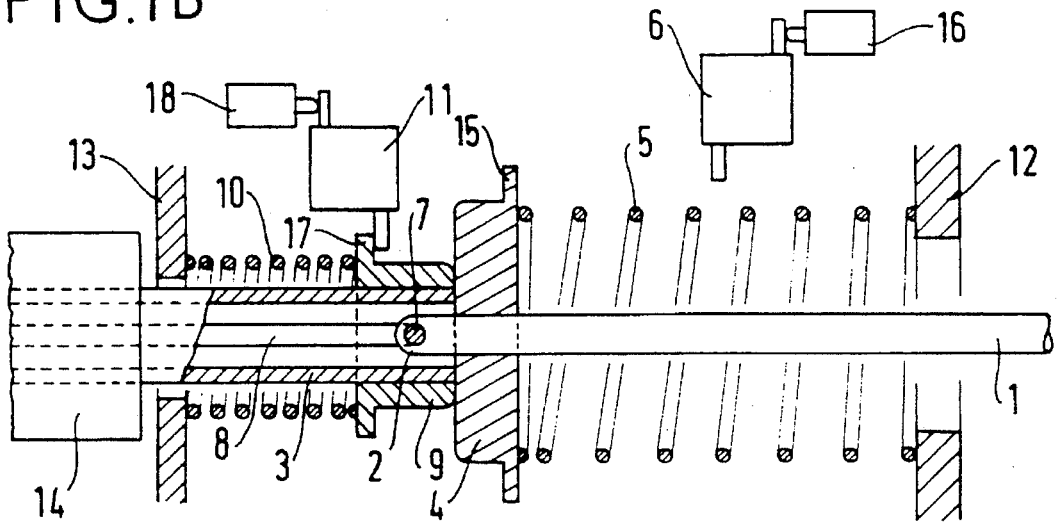
Figure 1C:
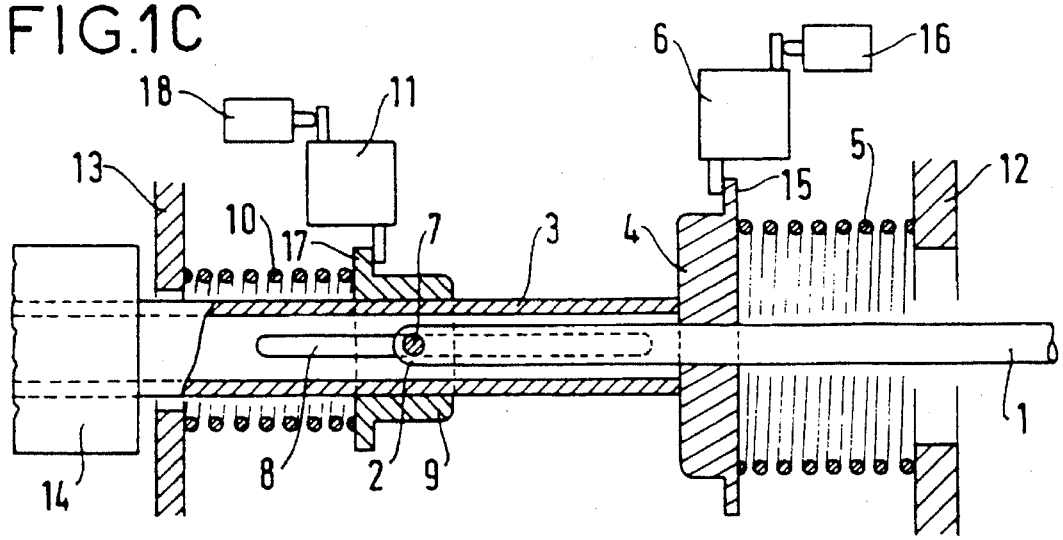

In a first variant embodiment as shown in FIGS. 1A, 1B, and 1C, the linear control apparatus for engaging and disengaging a circuit-breaker that includes a drive rod 1 provided with a control end 2, itself includes: a slidably-mounted tubular arm 3 which is actuated by a solenoid 14, which has the same longitudinal axis as the drive rod 1, and which is coupled to the drive rod 1 whose control end 2 is inside the tubular arm 3; and a "disengagement" first slide 4 which presses against the tubular arm 3 and through which the drive rod 1 passes, the first slide 4 being subjected to a "disengagement" first spring assembly 5 which displaces it from the circuit-breaker engaged position to the circuit-breaker disengaged position under the action of first control means 6 actuated on disengagement.

The first spring assembly 5 is constituted by a helical spring which is coaxial with the drive rod 1, and which has one of its ends pressed against a first fixed portion 12 and its other end pressed against the first slide 4, the first spring 5 being held compressed in the circuit-breaker engaged position by the first control means 6 constituted by retractable slide-retaining means for retaining the first slide 4.

The slide-retaining means 6 are constituted by a latch member co-operating with a flange 15 formed on the first slide 4, which member is actuated by a disengagement coil 16.

The control end 2 of the drive rod 1 is coupled to the tubular arm 3 via at least one projecting portion 7 fixed to the drive rod 1 and passing through a respective longitudinal slot 8 provided along the tubular arm 3. The control apparatus includes an "engagement" second slide 9 to which the drive rod 1 is fixed via its projecting portion 7, the engagement second slide being subjected to an "engagement" second spring assembly 10 which displaces it from the circuit-breaker disengaged position to the circuit-breaker engaged position under the action of second control means 11 actuated on engagement.

The second spring assembly 10 is constituted by a helical spring which is coaxial with the tubular arm 3, and which has one of its ends pressed against a second fixed portion 13 and its other end pressed against the second slide 9 to which the drive rod 1 is fixed via its projecting portion 7, the second spring 10 being held compressed in the circuit-breaker disengaged position by the second control means 11 constituted by retractable slide-retaining means for retaining the second slide 9.

The slide-retaining means 11 are constituted by a latch member co-operating with a flange 17 formed on the second slide 9, which member is actuated by an engagement coil 18.

In the position shown in FIG. 1A, the apparatus is in the engaged position. The first slide 4 driven by the arm 3 actuated by the solenoid 14 and by the second slide 9 driven by spring 10 is retained by latch member 6. The released spring 10 drives the second slide 9 and therefore the end 2 of the drive rod 1 to the engaged position.

On disengagement, as shown in FIG. 1B, the disengagement coil 16 is actuated and it releases spring 5 which drives the first slide 4 together with the arm 3 released by the solenoid 14 and together with the second slide 9, thereby driving the end 2 of the drive rod to the disengaged position. The flange 17 on the second slide 9 is then locked by latch member 11.

Once this position has been reached, the arm 3 is driven by the solenoid 14, as shown in FIG. 1C, thereby driving the first slide 4 while compressing spring 5, and slide 4 is locked via its flange 15 by latch member 6. The drive rod 1 is not displaced and it remains in the disengaged position coupled to the locked second slide 9 because of the presence of the slot 8. This operation may be performed within a very short length of time, i.e. about 0.3 seconds, corresponding to the standardized circuit-breaker isolation time.

The apparatus is then in a position to be re-engaged quickly by releasing the flange 17 on the second slide 9 so as to return to the engaged position shown in FIG. 1A.

The "disengagement" first spring 5 develops a force that is greater than the force developed by the "engagement" second spring 10, and the springs are therefore dimensioned accordingly.

Figure 2A:
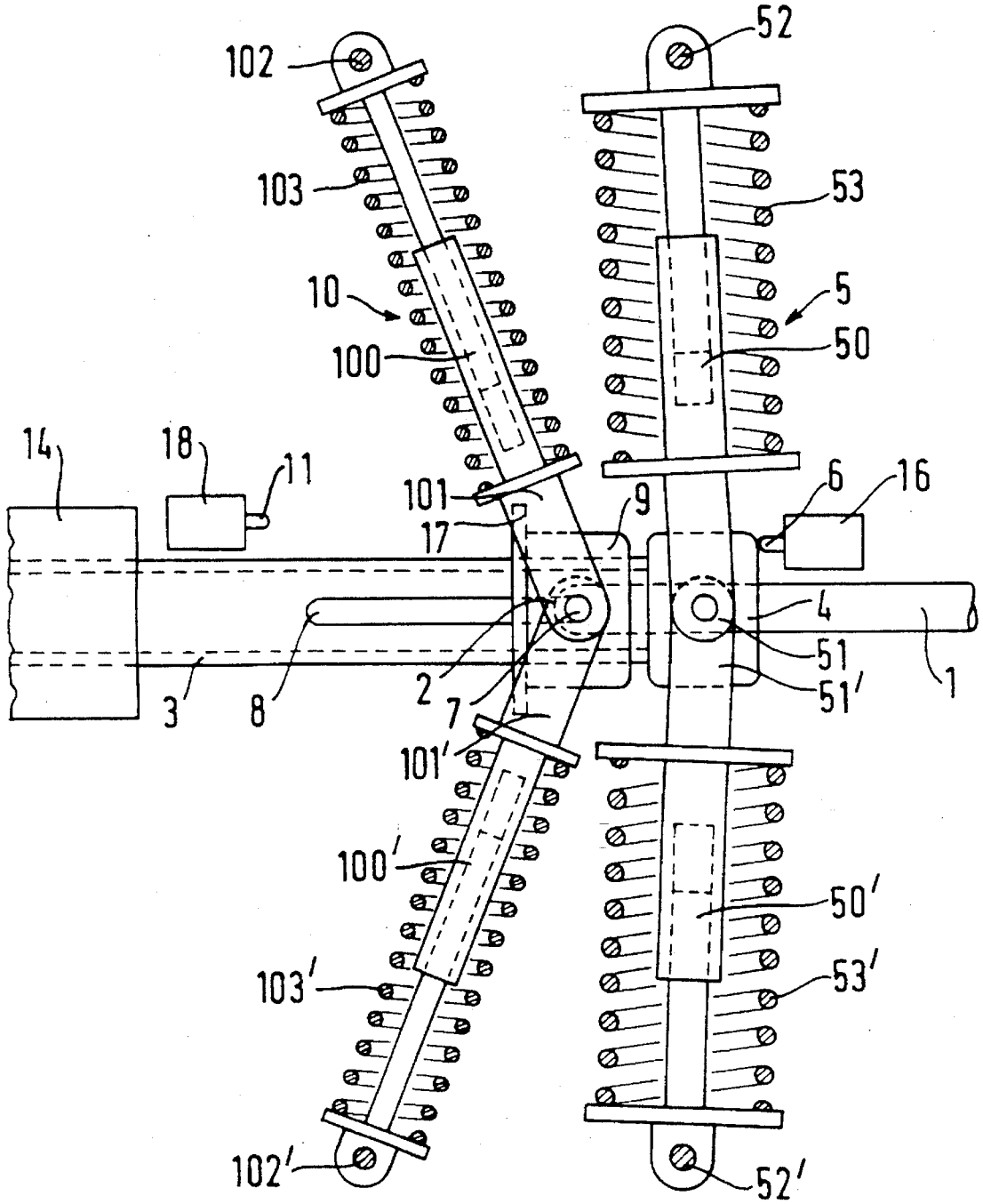
FIGS. 2A, 2B, and 2C are longitudinal section views through a second variant embodiment of the apparatus of the invention, respectively in the engaged position, during disengagement, and in the disengaged position.
Figure 2B:
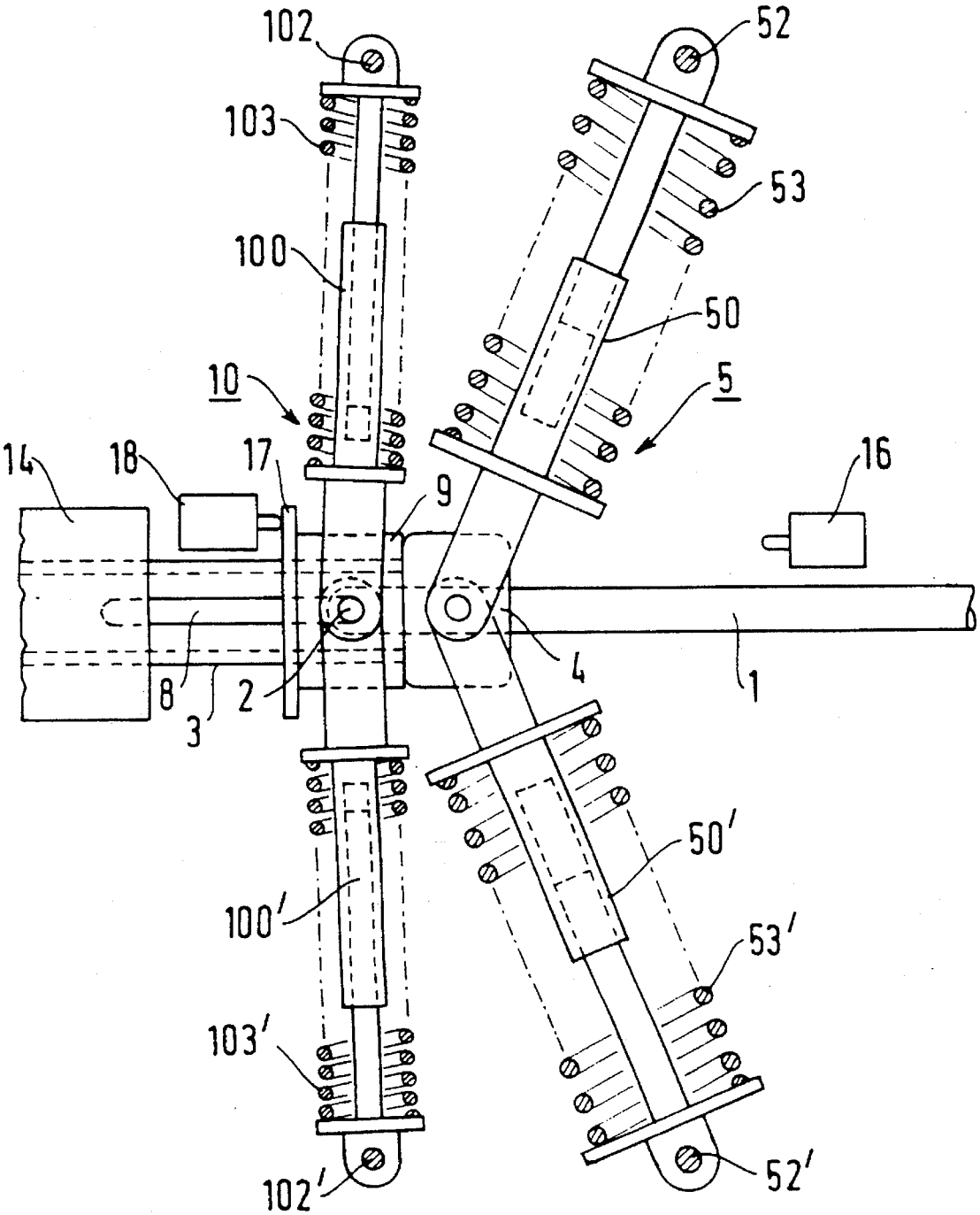
Figure 2C:
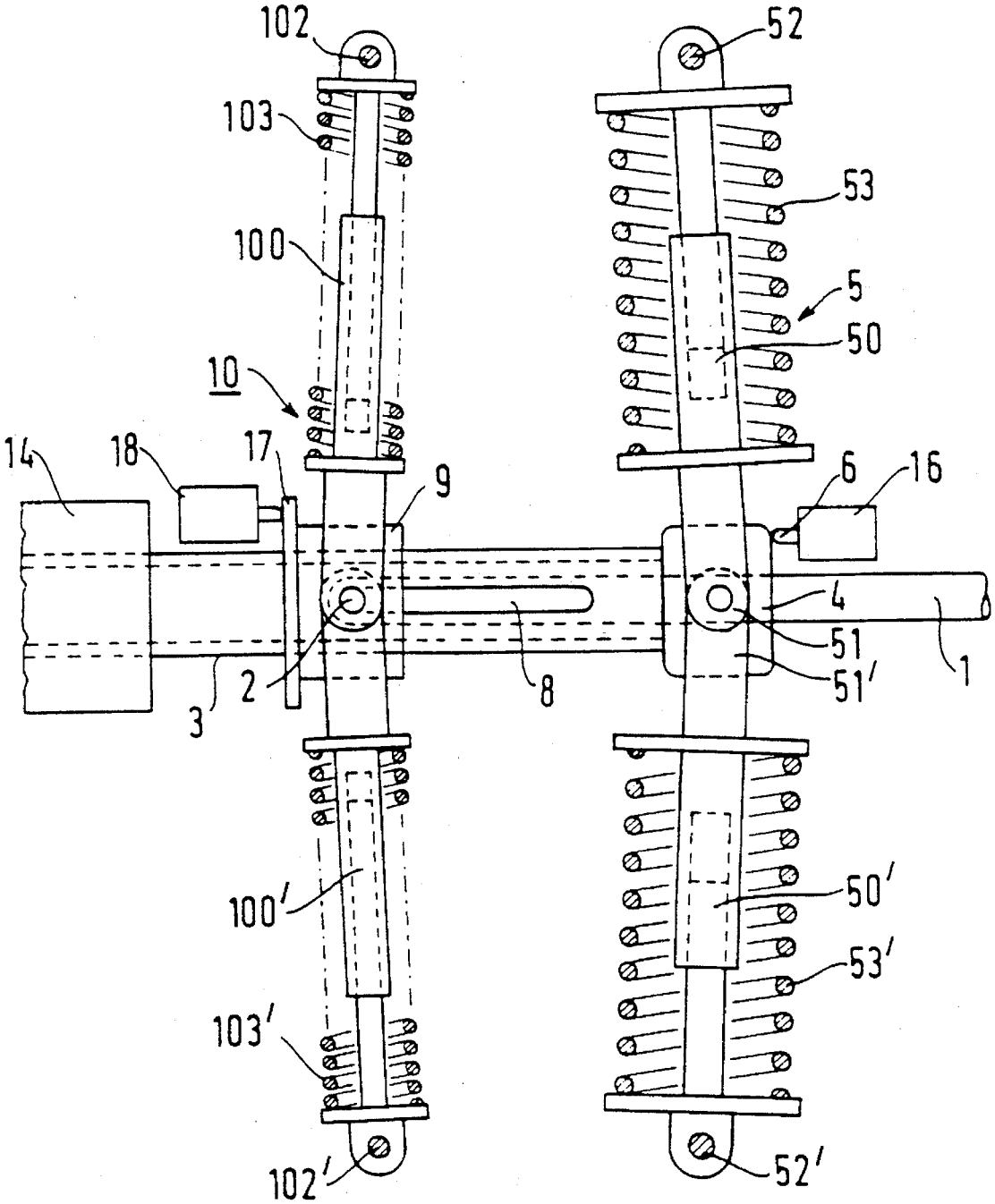

FIGS. 2A, 2B, and 2C show a second embodiment of the apparatus of the invention, in which the spring assemblies 5, 10 are constituted by snap-acting members that act suddenly relative to a over-center unbalanced position.

The first spring assembly 5 is constituted by two telescopic arms 50, 50' which have their longitudinal axes lying in the same plane. Each one of the facing ends of the arms is connected to the first slide 4 via a respective clevis-type pivoting link 51, 51', and the other end of each arm is pivotally fixed to a respective fixed point 52, 52', a spring 53, 53' surrounding the arm 50, 50' being compressed between the clevis 51, 51' and the fixed end.

The first control means 6 are constituted by a drive member for driving the first slide 4, which drive member is an arm 6 actuated by a disengagement coil 16.

The second spring assembly 10 is constituted by two telescopic arms 100, 100' which have their longitudinal axes lying in the same plane. Each one of the facing ends of the arms is connected to the second slide 9 via a respective clevis-type pivoting link 101, 101', and the other end of each arm is pivotally fixed to a respective fixed point 102, 102', a spring 103, 103' surrounding the arm 100, 100' being compressed between the clevis 101, 101' and the fixed end.

The second control means 11 are constituted by a drive member for driving the second slide 9, which drive member is an arm 11 actuated by an engagement coil 18.

In the position shown in FIG. 2A, the apparatus is in the engaged position. The first slide 4 is driven by the arm 3 actuated by the solenoid 14. Spring assembly 10 drives the second slide 9 and therefore the end 2 of the drive rod 1 to the engaged position. In this position, a flange 17 formed on the second slide 9 abuts against a fixed element (not shown). In this way, there is a gap between the slides 4 and 9, and there is also a gap between the projecting portion 7 and the end of the slot 8.

Furthermore, the first spring assembly 5 is in a position that is very close to its over-center position corresponding to a vertically aligned position in which the arms 50 and 50' are in vertical alignment, as shown in FIG. 2A.

On disengagement, as shown in FIG. 2B, the disengagement coil 16 is actuated and it drives out arm 6 which drives spring assembly 5 and arm 3 released by the solenoid 14. This takes place easily over the above mentioned gaps, and once it has been driven in this way, spring assembly 5 has gone beyond its over-center position and it in turn drives arm 3 and the second slide 9, thereby driving the end 2 of the drive rod 1 to the disengaged position. The flange 17 on the second slide 9 abuts against the arm 11 of the engagement coil 18. In this position, it is the second spring assembly 10 which is in a position that is very close to its over-center position corresponding to a vertically aligned position in which arms 100 and 100' are in vertical alignment, as shown in FIG. 2B.

Once this position has been reached, arm 3 is driven by the solenoid 14, as shown in FIG. 2C, thereby driving the first slide 4 together with the first spring assembly 5 against the arm 6 of the disengagement coil 16. The drive rod 1 is not displaced and it remains in the disengaged position coupled to the locked second slide 9 because of the presence of the slot 8. This operation may be performed within a very short length of time, i.e. about 0.3 seconds, corresponding to the standardized circuit-breaker isolation time.

The apparatus is then in a position to be re-engaged quickly by the second slide 9 being driven by the arm 11 of the engagement coil 18 so as to return to the engaged position shown in FIG. 2A.

The "disengagement" first spring assembly 5 develops a force that is greater than the force developed by the "engagement" second spring assembly 10, and the spring assemblies are therefore dimensioned accordingly.

I claim:

1. Linear control apparatus for engaging and disengaging a circuit-breaker that includes a drive rod provided with a control end, the apparatus itself including a slidably-mounted tubular arm which is actuated by a solenoid, which has the same longitudinal axis as the drive rod, and which is coupled to the drive rod whose control end is inside the tubular arm, and a "disengagement" first slide which presses against the tubular arm and through which the drive rod passes, the first slide being subjected to a "disengagement" first spring assembly which displaces it from the circuit-breaker engaged position to the circuit-breaker disengaged position under the action of first control means actuated on disengagement, wherein the control end of the drive rod is coupled to the tubular arm via at least one projecting portion fixed to the drive rod and passing through a respective longitudinal slot provided along the tubular arm, and wherein the control apparatus includes an "engagement" second slide to which the drive rod is fixed via its projecting portion, the engagement second slide being subjected to an "engagement" second spring assembly which displaces it from the circuit-breaker disengaged position to the circuit-breaker engaged position under the action of second control means actuated on engagement.

2. Apparatus according to claim 1, wherein the first spring assembly is constituted by a helical spring which is coaxial with the drive rod, and which has one of its ends pressed against a first fixed portion and its other end pressed against the first slide, the first spring being held compressed in the circuit-breaker engaged position by the first control means constituted by retractable slide-retaining means for retaining the first slide.

3. Apparatus according to claim 1, wherein the first spring assembly is constituted by two telescopic arms which have their longitudinal axes lying in the same plane, each one of the facing ends of the arms being connected to the first slide via a respective pivoting link, and the other end of each arm being pivotally fixed to a respective fixed point, a spring surrounding the arm being compressed between the pivoting link and the fixed end.

4. Apparatus according to claim 3, wherein the first control means are constituted by a drive member for driving the first slide.

5. Apparatus according to claim 1, wherein the second spring assembly is constituted by a helical spring which is coaxial with the tubular arm, and which has one of its ends pressed against a second fixed portion and its other end pressed against the second slide to which the drive rod is fixed via its projecting portion, the second spring being held compressed in the circuit-breaker disengaged position by the second control means constituted by retractable slide-retaining means for retaining the second slide.

6. Apparatus according to claim 1, wherein the second spring assembly is constituted by two telescopic arms which have their longitudinal axes lying in the same plane, each one of the facing ends of the arms being connected to the second slide via a respective pivoting link, and the other end of each arm being pivotally fixed to a respective fixed point, a spring surrounding the arm being compressed between the pivoting link and the fixed end.

7. Apparatus according to claim 6, wherein the second control means are constituted by a drive member for driving the second slide.

* * * * *